US006695064B2

(12) United States Patent
Dallas

(10) Patent No.: US 6,695,064 B2
(45) Date of Patent: Feb. 24, 2004

(54) SLIP SPOOL AND METHOD OF USING SAME

(76) Inventor: L. Murray Dallas, 790 River Oaks Dr., Fairview, TX (US) 75069

( * ) Notice: Subject to any disclaimer, the term of this patent is extended or adjusted under 35 U.S.C. 154(b) by 25 days.

(21) Appl. No.: 10/034,032

(22) Filed: Dec. 19, 2001

(65) Prior Publication Data

US 2003/0111271 A1 Jun. 19, 2003

(51) Int. Cl.[7] ..... E21B 34/02

(52) U.S. Cl. ..... 166/382; 166/85.4; 166/88.2; 166/95.1

(58) Field of Search ..... 166/382, 85.4, 166/86.1, 88.2, 88.3, 88.4, 95.1; 285/333; 175/423

(56) References Cited

U.S. PATENT DOCUMENTS

| | | | | |
|---|---|---|---|---|
| 4,244,093 | A | 1/1981 | Klingensmith | 29/256 |
| 4,681,193 | A | 7/1987 | Crowe | 188/67 |
| 4,715,456 | A | 12/1987 | Poe, Jr. et al. | 175/423 |
| 4,940,118 | A | 7/1990 | Cox | 188/67 |
| 5,012,865 | A | 5/1991 | McLeod | 166/90 |
| 5,027,926 | A | 7/1991 | Cox | 188/67 |
| 5,515,925 | A | 5/1996 | Boychuk | 166/379 |
| 5,515,926 | A | 5/1996 | Boychuk | 166/379 |
| 5,590,867 | A | 1/1997 | Van Winkle | 251/1.3 |
| 5,785,121 | A | 7/1998 | Dallas | 166/90.1 |
| 5,819,851 | A | 10/1998 | Dallas | 166/308 |
| 5,988,274 | A | 11/1999 | Funk | 166/77.4 |
| 6,145,596 | A | 11/2000 | Dallas | 166/379 |
| 6,209,633 | B1 | 4/2001 | Haynes | 166/72 |
| 6,220,363 | B1 | 4/2001 | Dallas | 166/382 |
| 6,234,253 | B1 | 5/2001 | Dallas | 166/377 |
| 6,289,993 | B1 | 9/2001 | Dallas | 166/386 |

OTHER PUBLICATIONS

U.S. patent application Ser. No. 09/537,629, filed Mar. 29, 2000.

U.S. patent application Ser. No. 09/791,980, filed Feb. 23, 2001.

U.S. patent application Ser. No. 09/791,980, filed Nov. 15, 2001.

*Primary Examiner*—William Neuder
(74) *Attorney, Agent, or Firm*—Nelson Mullins Riley & Scarborough, LLP

(57) ABSTRACT

A slip spool for selectively supporting or snubbing a tubing string suspended in a wellbore can be mounted to a wellhead. The slip spool has an axial passage to be aligned with the wellbore and at least two radial passages extending through a side wall of the slip spool and communicating with the axial passage. At least two slip blocks are slidably supported within the respective radial passages. The slip spool further includes actuators for moving the respective slip blocks between an extended position in which they engage a component in the tubing string that provides a weight-bearing shoulder, and a retracted position in which the slip blocks clear the axial passage of the slip spool. The slip spool facilitates live well service operations and eliminates scoring of an exterior surface of the tubing.

28 Claims, 11 Drawing Sheets

SLIP SPOOL AND METHOD OF USING SAME

FIELD OF THE INVENTION

The present invention relates to slip and snubbing assemblies and, more particularly, to a slip spool used to selectively support or snub a tubing string during a well operation.

BACKGROUND OF THE INVENTION

In the oil industry, slips have been essential components of oil field drilling and servicing equipment for many years. Conventional slips are sets of heavy hinged blocks with gripping dies that are positioned in a slip bowl of a rotary table to engage a drill pipe, casing or production tubing. Angled surfaces in each slip block mate with angled surfaces in the slip bowl. The angled surfaces cause axial forces exerted by the weight of the pipe on the blocks to be transferred into lateral gripping pressure on the pipe, which supports the pipe and thus prevents it from dropping into the bore hole.

As is well known in the art, conventional slips are manually engaged by oil field personnel who physically maneuver the slips into the slip bowl so that they slide into engagement with the casing or drill pipe. The slips are disengaged by upward axial movement of the casing, drill pipe, or production tubing to take the weight off the slips. The slips are then lifted out of the slip bowl. An example of such conventional slips is described in U.S. Pat. No. 4,244,093, which is entitled TUBING SLIP PULLING TOOL and issued to Klingensmith on Jan. 13, 1981.

As is also well known in the art, certain wells have natural pressure that may overburden the weight of a plugged tubing string. Consequently, maneuvering the tubing string requires a snubbing unit to prevent the tubing string from being ejected from the well by the natural well pressure. The snubbing unit functions like invented slips, and grips the tubing string to hold it down against the fluid pressure in the well.

There is an ever increasing demand for obtaining more oil and gas from existing wells. After a primary recovery term of a well has expired, some form of reworking is required to obtain remaining oil and/or gas from the well. Usually in reworking those wells, such as in preparation for a well stimulation process, the tubing string must be removed from the well or pulled up for attachment of wellhead tools, and then lowered again to insert the wellhead tools through the wellhead. During such operations, the tubing string is secured by slips or, less often, by a snubbing unit. It is therefore necessary to remove and set the slips or the snubbing unit in preparation for a well stimulation process. Consequently, slips and snubbing units are not only frequently used during well drilling and completion, they are also required equipment for well re-completion, servicing and workover.

However, the handling of slips and snubbing units can be dangerous and time-consuming. Mechanical equipment for moving slips has also been utilized in the past to alleviate the manual labor. An example of a hydraulically operated slip assembly used to grip pipe as it is being run into or pulled from a well is described in U.S. Pat. No. 5,027,926, which is entitled SLIP ASSEMBLY and issued to Cox on Jul. 2, 1991. Although Cox eliminates the manual handling of slips, he does not address the problem of pressure containment, which becomes an issue when a live well requires some form of rework or stimulation. Without pressure containment, a live well must be "killed" before control valves or a BOP in the wellhead can be opened. As is known in the art, killing the well is a time-consuming and expensive process. Killing the well may also undo a significant port of the benefits of well stimulation.

The problem of manipulating tubing in a live well has also been addressed, however. Light-duty slips for use with coiled tubing have been invented, as described in U.S. Pat. No. 5,590,867, entitled BLOWOUT PREVENTER FOR COILED TUBING, which issued to Van Winkle on Jan. 7, 1997. The slips incorporated in Van Winkle's blowout preventer do not have a conventional wedge structure, however. Consequently, the gripping pressure on the pipe is not increased by the weight of the pipe, and the slips incorporated in Van Winkle's blowout preventer are not adapted to support the considerable weight of a jointed tubing string.

Another disadvantage of prior art slip assemblies arises because the tubing string is supported by friction forces between the slips and the exterior surface of the tubing under the gripping pressure on the tubing exerted by the slips. In order to increase the friction, the gripping surface of the slips is usually provided with gripping teeth. Although ideally slips do not damage the tubing surface, it has been found that even a single actuation of the slips against the tubing can score the exterior surface of the tubing. In today's high performance well operations at elevated fluid pressures, this scoring can reduce the useful life of the tubing, particularly in the case of coil tubing, and potentially cause fluid leaks as the tubing is pulled through seals, such as the tubing rams of a BOP.

There is therefore a need for a pressure containing slip spool that overcomes the shortcomings of prior art slip assemblies.

SUMMARY OF THE INVENTION

An object of the invention is to provide a pressure containment slip spool for selectively supporting a tubing string suspended in a wellbore, by engaging a component in the tubing string having a weight-bearing shoulder adapted to be engaged by slip members of the slip spool.

A further object of the invention is to provide an apparatus for selectively supporting a tubing string in a wellbore, which does not score an exterior surface of the tubing and can be used for either slip or snub operations.

The invention therefore, provides an apparatus that includes a slip spool that can be mounted to a wellhead for selectively supporting a tubing string suspended in the wellbore. The slip spool has an axial passage to be aligned with the wellbore for permitting the tubing string to extend therethrough, and at least two radial passages extending through a wall of the slip spool and communicating with the axial passage. The slip spool is provided with at least two slip blocks which are slidably supported within the respective at least two radial passages. The slip spool further includes means for moving the respective slip blocks between an extended position in which the slip blocks engage a component in the tubing string having a weight-bearing shoulder adapted to be engaged by the slip blocks, and a retracted position in which the slip blocks clear the axial passage of the slip spool.

In accordance with another aspect, the invention provides an adapter pin for providing the weight-bearing shoulder in the tubing string. The adapter pin comprises a tubular collar having threads at a top end and at a bottom end thereof for connecting the adapter pin to a tubular, tubing head or a downhole tool. The bottom end preferably further includes an inwardly and upwardly bevel that functions as the weight-bearing shoulder. The slip blocks in the slip spool are adapted to engage the weight-bearing shoulder of the adapter pin, thereby supporting the weight of the tubing string.

In an alternate embodiment, the adapter pin is configured to function for both slip and snub operations. The embodiment of the adapter pin includes an area of reduced diameter located between the top and bottom ends; a top edge of the area provides the weight-bearing shoulder for slip operations and a bottom edge of the area provides the weight-bearing shoulder for snubbing operations. The weight-bearing shoulders may be inwardly beveled, and the slip blocks may be ridged to engage the bevels, to ensure that the slip blocks cannot disengage the adapter pin unless a load extended by the tubing string is removed from the slip blocks.

The apparatus in accordance with the invention permits the slip blocks to be extended and retracted in a convenient and safe manner, particularly during a live well operation. Scoring of the exterior surface of the tubing is also eliminated, thereby increasing the life expectancy of the tubing.

Other advantages and features of the invention will be better understood with reference to preferred embodiments of the invention described hereinafter.

BRIEF DESCRIPTION OF THE DRAWINGS

Having thus generally described the nature of the invention, reference will now be made to the accompanying drawings, showing by way of illustration the preferred embodiments thereof, in which.

DETAILED DESCRIPTION OF THE PREFERRED EMBODIMENTS

The present invention provides an apparatus that includes a slip spool and a tubular collar for selectively supporting and snubbing a tubing string suspended in a wellbore, and methods for using them during live well operations. The spool and collar can be used to support or snub a coil tubing string or a jointed tubing string. The slip spool can be operated under well pressure, so that in a live well operation it is not necessary to kill the well in order to run a tubing hanger or the like through the wellhead. The slip spool can be operated remotely at a safe distance from the wellhead, if desired. Safety is therefore a major factor and benefit of the invention.

Figure 1:
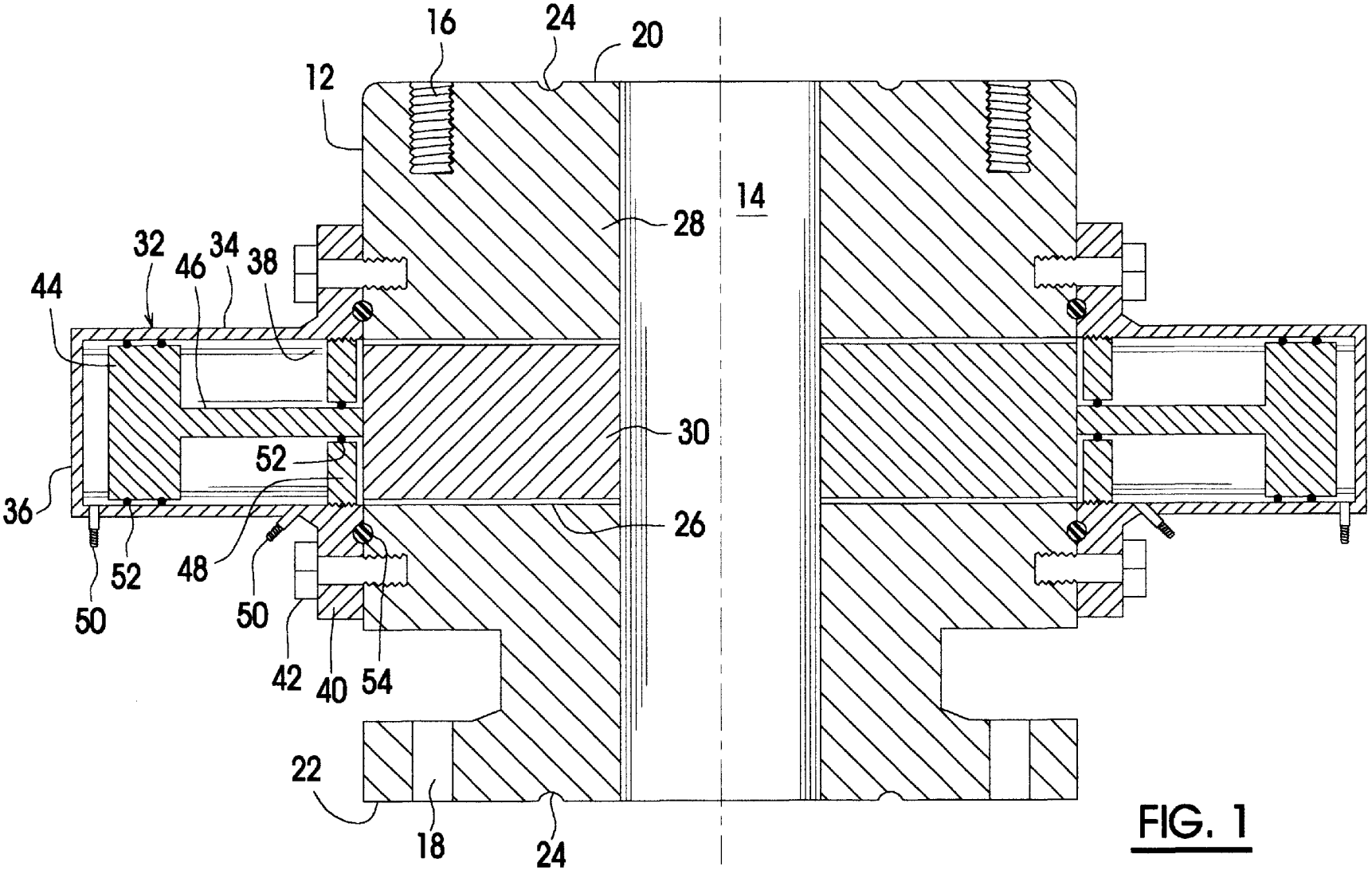
FIG. 1 is a cross-sectional view of a slip spool in accordance with one embodiment of the invention, showing slip blocks in a retracted position.

FIG. 1 is a cross-sectional view of a slip spool in accordance with one embodiment of the invention. The slip spool 12 includes an axial passage 14, which is aligned with a wellbore and provides full-bore access when the slip spool 12 is mounted to a wellhead. A bottom flange 22 includes bores 18 for bolting the slip spool 10 to a top of another spool, such as a blowout preventer (BOP) or the like. A stud pad 20 of the slip spool body 12 includes threaded bores 16 for receiving studs for mounting another spool, Bowen union or adapter to a top of the slip spool 10. An annular groove 24 is also provided in the stud pad 20 and bottom flange 22 for receiving a gasket seal (not shown) when the slip spool 10 is mounted to the wellhead.

The slip spool 12 is also provided with at least two radial passages 26 that extend through the side walls 28 and communicate with the axial passage 14. Slip blocks 30 are slidably supported in the respective radial passages 26.

Figure 2:
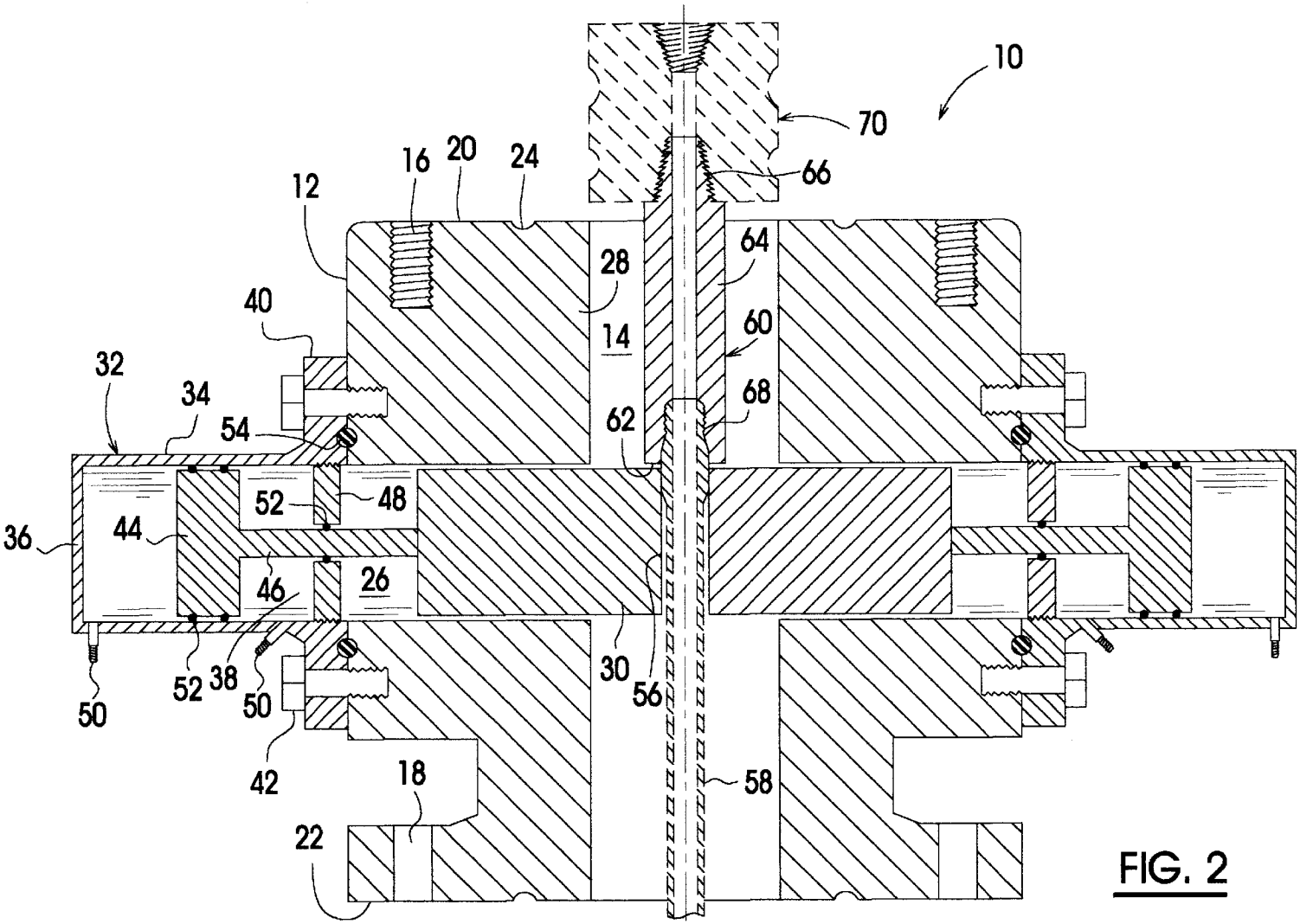
FIG. 2 is a cross-sectional view of an apparatus in accordance with the invention, illustrating the slip spool shown in FIG. 1 and an adapter pin in a tubing string supported by the slip blocks, which are in an extended position.

The slip spool 12 further includes means, for example, hydraulic actuators 32, for moving the respective slip block 30 between a retracted position as shown in FIG. 1, and an extended position as shown in FIG. 2. The hydraulic actuators 32 are aligned with the radial passages 26, which are perpendicular to the axial passage 14. Each hydraulic actuator 32 includes a cylinder 34 having an outer end 36 and an inner end 38. A radial flange 40 provided at the inner end 38 of the cylinder 34 is bolted to the side walls 28 of the slip spool 12 by mounting bolts 42. A piston 44 with a piston rod 46 is slidably received in the cylinder 34 and the piston rod 46 is guided by a cylinder end plate 48, which is threadedly secured to the inner end of the cylinder 34. The piston rod 46 is connected to an outer end of one slip block 30 so that the slip block 30 is moved together with the piston 44. Hydraulic nipples 50 are provided at inner and outer ends 38, 36 of the cylinder 34 for connecting pressurized hydraulic fluid lines (not shown) to the hydraulic actuator 32. O-ring seals 52 are provided between the piston 44 and the cylinder 34, and between the piston rod 46 and the end plate 48. A gasket seal 54 is also provided between the radial flange 40 and the side wall 28 of the slip spool 12.

It should be noted that any other known actuator can be used instead of the hydraulic actuators 32 for moving the slip blocks 30. For example, mechanical screws can be used, as will be explained below in more detail with reference to FIG. 5*b*.

The slip blocks 30 in their retracted position, as shown in FIG. 1, are received within the respective radial passages 26 of the slip spool 12, thereby providing full-bore access to the well through the axial passage 14. When the slip blocks 30 are in their extended position, as shown in FIG. 2, the inner ends 56 thereof, which have a contoured profile (see FIG. 4), are closed around a tubing 58 (shown in broken lines). As shown in FIG. 2, an apparatus 10 in accordance with the invention includes a slip spool 12 and an adapter pin 60, which is used in combination with the slip spool 12. The adapter pin 60 connects to the tubing 58 (shown in broken lines), has a diameter greater than the diameter of the tubing 58 and includes a weight bearing shoulder 62 at its bottom end. The weight-bearing shoulder 62 is supported by a top edge of the inner ends 56 of the slip blocks 30 so that the entire weight of the tubing 58 is supported by the slip spool 12. Thus, there is no frictional force or gripping pressure required to support the tubing string and, therefore, scoring and deformation of an exterior surface of the tubing 58 is avoided. The hydraulic actuators 32 provide force to extend and retract the slip blocks 30, rather than generating gripping pressure to support the tubing string.

The adapter pin 60 generally includes side walls 64 with a pin thread 66 at a top end thereof, and a box thread 68 at a bottom end thereof. The box thread 68 at the bottom end of the side wall 64 is for engagement with threads at the top end of the tubing string 58, and the pin thread 66 at the top end of the side wall 64 is for engagement with threads at the bottom of a tubing hanger 70 (shown by broken lines). The adapter pin 60 is preferably long enough that the top end extends above the stud pad 20 of the slip spool 12, or higher, when the weight-bearing shoulder 62 is supported by the slip blocks 30, so that the tubing hanger 70 can be connected to the adapter pin 60, or any one of a tubular, a downhole tool and a wellhead component that is to be inserted through the axial passage 14 into the well.

It should also be understood that the slip blocks 30 can engage any weight-bearing shoulder of a tool or component in a tubing string, when such a component is available. Nevertheless, for more security, a specially designed adapter pin 61 (FIG. 3) is provided in an apparatus 11, in accordance with another embodiment of the invention. The adapter pin 61 has a structure similar to the adapter pin 60 shown in FIG. 2. The bottom end of the side wall 64, however, includes an inward and upward bevel 72 that provides the weight-bearing shoulder.

Figure 3:
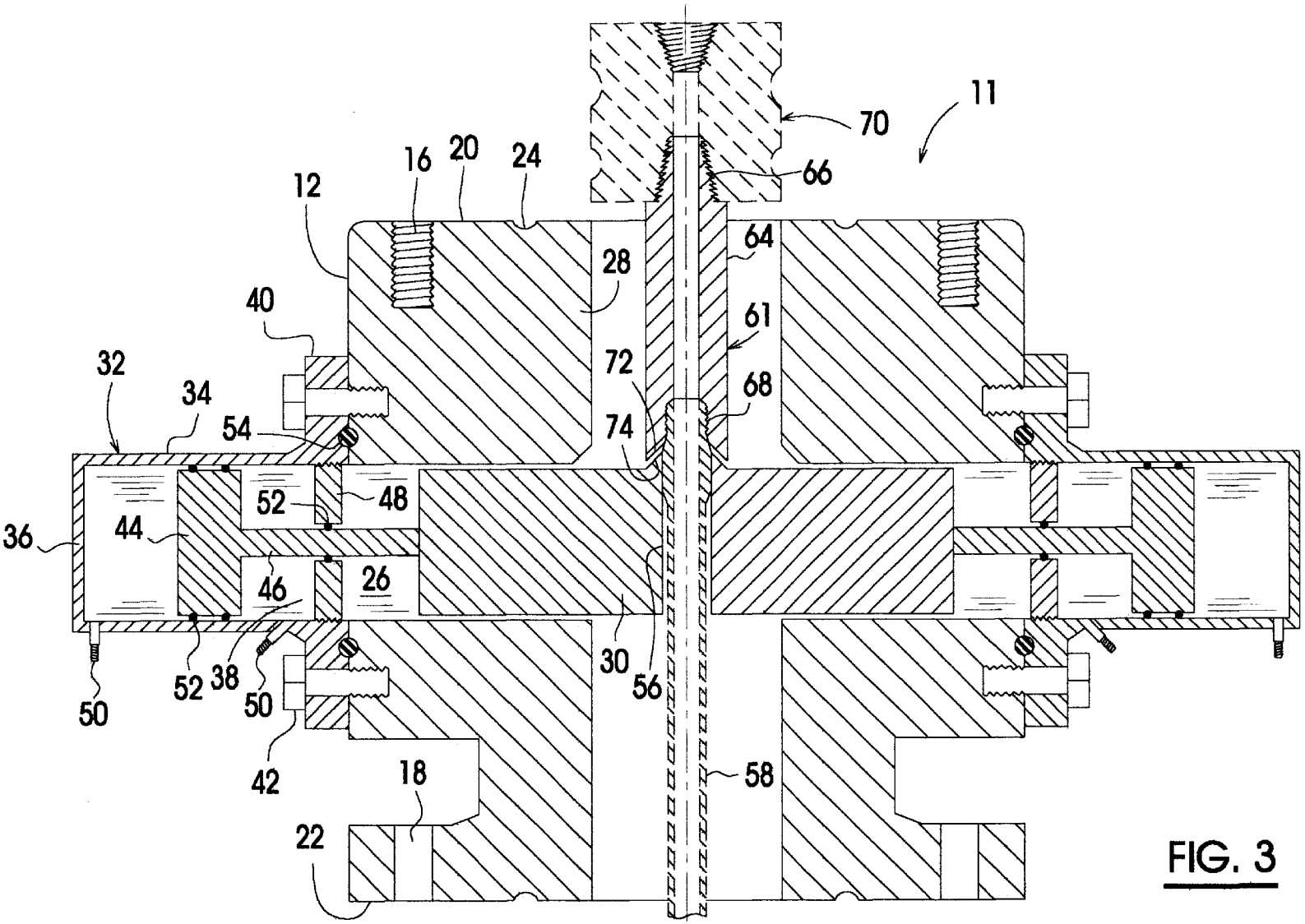
FIG. 3 is a cross-sectional view of an apparatus in accordance with another embodiment of the invention, showing the slip blocks in the extended position.

Apparatus 11 shown in FIG. 3 includes components and structural features similar to those indicated by similar numerals in FIG. 2, and will not be redundantly described. The slip blocks 30, however, include a wedge-shaped ridge 74 along an upper edge of the contoured portion of the inner end 56. The wedge-shaped ridge 74 has a profile complimentary with the beveled bottom end 72 of the adapter pin 61. The beveled bottom end 72 of the adapter pin 61, in combination with the wedge-shaped ridge 74 of the slip blocks 30, advantageously provides a secure engagement under the weight of the tubing string in order to ensure that the slip blocks 30 cannot back off from the adapter pin in the case of hydraulic power failure. It also adds a safety factor, since the slip blocks cannot be retracted by the actuators 36 unless the weight of the tubing string 58 is lifted off the slip blocks 30.

Figures 3B, 3C:
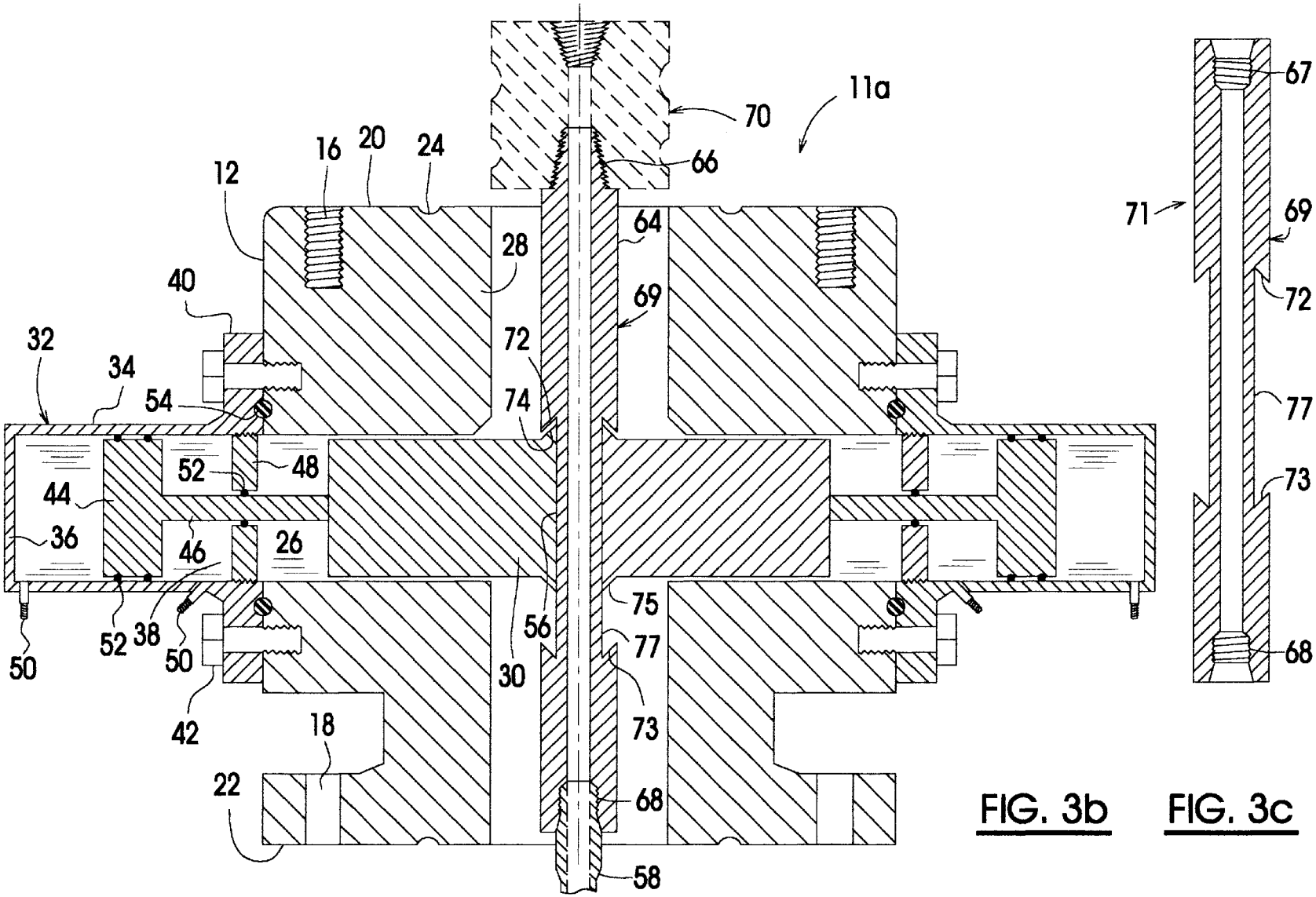
FIG. 3*b* is a cross-sectional view of an apparatus in accordance with another embodiment of the invention showing the slip blocks in an extended position and an adapter pin configured for both slip and snub operations.
FIG. 3*c* is a cross-sectional view of yet another embodiment of an adapter pin in accordance with the invention.
Figure 3A:
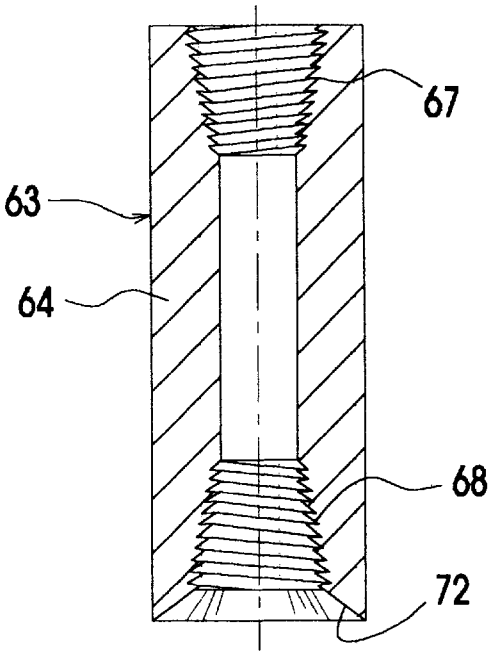
FIG. 3*a* is a cross-sectional view of an another embodiment of an adapter pin used with the apparatus shown in FIG. 3.

FIG. 3*a* illustrates an adapter pin 63 in accordance with a further embodiment of the invention. The adapter pin 63 includes components and structural features that are similar to those of the adapter pin 61 illustrated in FIG. 3, which are not redundantly described. Instead of the pin thread 66 of the adapter pin 61 shown in FIG. 3, however, the top end of the adapter pin 63 includes a box thread 67 for connection to any one of a tubular, a downhole tool and a wellhead component having pin threads.

FIG. 3*b* illustrates another embodiment of the apparatus 16 in which the slip blocks 30 and an adapter pin 69 are adapted to function as a slip or snub unit. In addition to the wedge-shaped ridge 74 along the upper edge of the contoured portion of the inner end 56 of the slip blocks 30, there is a wedge-shaped ridge 75 along a lower edge of the contoured portion of the inner end 56. The adapter pin 69 is longer and includes an area of reduced diameter 77 between opposed weight-bearing shoulders 72 at the top end 73 at the bottom. The weight-bearing shoulders 72 and 73 are preferably beveled, as described above. If there is a high natural pressure in the well, the wedge-shaped ridge 75 engages the weight-bearing shoulder 73 to snub the tubing string 58 to prevent it from being ejected from the well. Other parts of the apparatus 11 shown in FIG. 3*a* are the same as described above.

FIG. 3*c* illustrates an adapter pin 71 in accordance with a further embodiment of the invention. The adapter pin 71 is identical to the adapter pin 69 described above, except that rather than a pin thread 66 at the top end, the adapter pin 71 includes a box thread 67 at the top end and a box thread 68 at the bottom end for connection to any one of a tubular, a downhole tool and a wellhead component having pin threads. As will also be understood by those skilled in the art, the adapter pins 69, 71 may also have pin threads 66 on each end.

Figure 4:
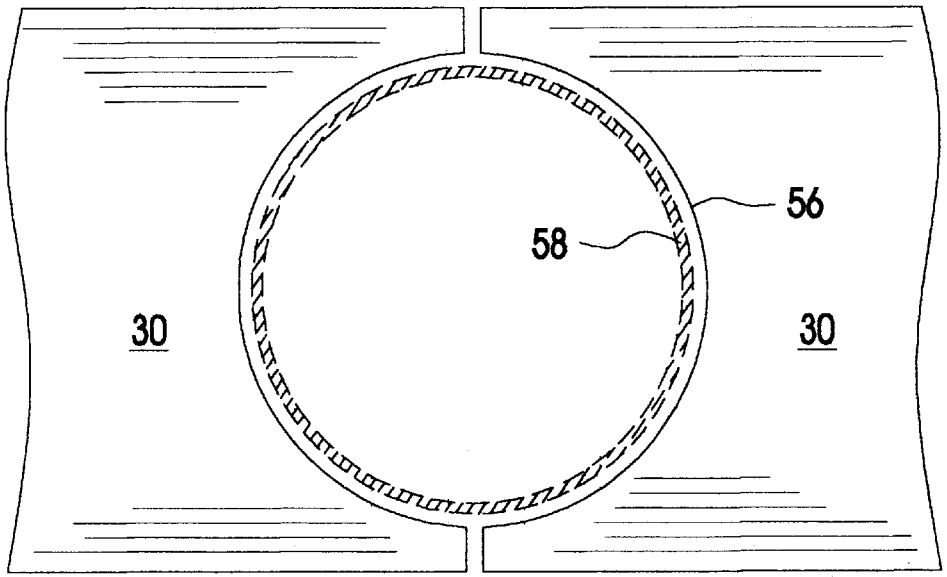
FIG. 4 is a top plan view of the slip blocks closed around a well tubing, as shown in FIG. 3, but with the adapter pin not shown.

Apparatus 10 and 11 shown in FIGS. 2 and 3 may be provided with more than two slip blocks 30, for example, three or four slip blocks 30 spaced circumferentially about the center passage 14 of the slip spool 12. Each of the slip blocks 30 of the apparatus 10 and 11 are generally wider than the diameter of the tubing 58, as shown in FIG. 4, to provide a substantially complete annular support edge contacting the load-bearing shoulder 62 or 72 of the respective adapter pins 60, 61, 69 or 71 (see FIGS. 2 and 3), in order to maximize the contact surface with the load-bearing shoulder, and thereby reduce the amount of stress to which the adapter pins 60, 61, 69 or 71 are exposed.

Figure 5:
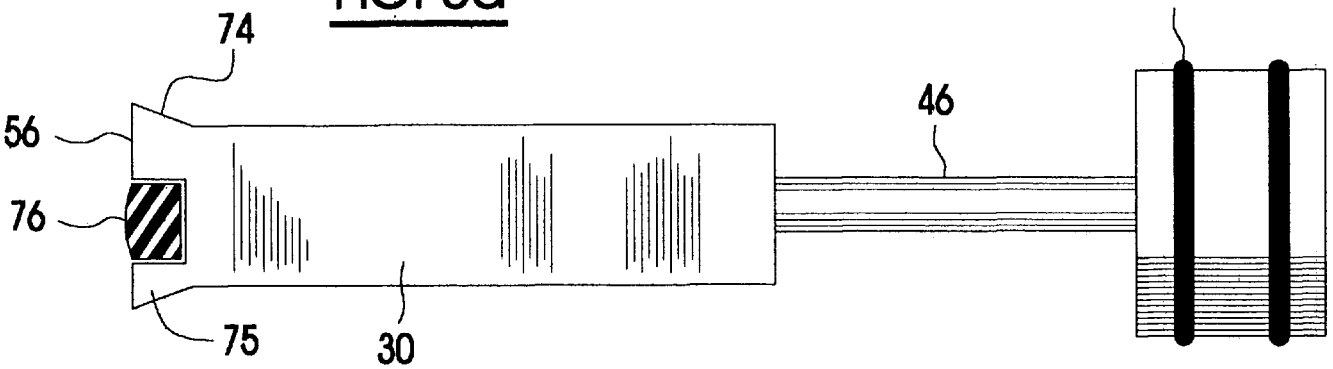
FIG. 5 is a side view of a slip block used in a further embodiment of the invention, the slip block including a tubing seal for providing a fluid-tight seal around a tubing.

In accordance with a further embodiment of the invention, the slip blocks 30 are modified to function as slip/snub rams and tubing rams of a blowout preventer (BOP). The tubing rams of a BOP seal around the tubing when they are extended to close the annulus of the BOP. For this purpose, the slip blocks 30 are made wide enough to block the axial passage 14 of the slip spool 12 (FIGS. 2 and 3). An elastic seal 76 is provided in the inner ends 56 of the respective slip blocks 30, as shown in FIG. 5. The elastic seals 76 seal around the tubing 68 in a manner well known in the art. Other seals (not shown) are also provided between the slip blocks 30 and the respective radial passages 26, so that the well pressure is contained within the annulus of the slip spool 12 below the slip blocks 30 when the slip blocks 30 are in the extended position. The elastic seals are commonly used for the tubing rams of BOPs and are therefore well known in the art.

Figure 6A:
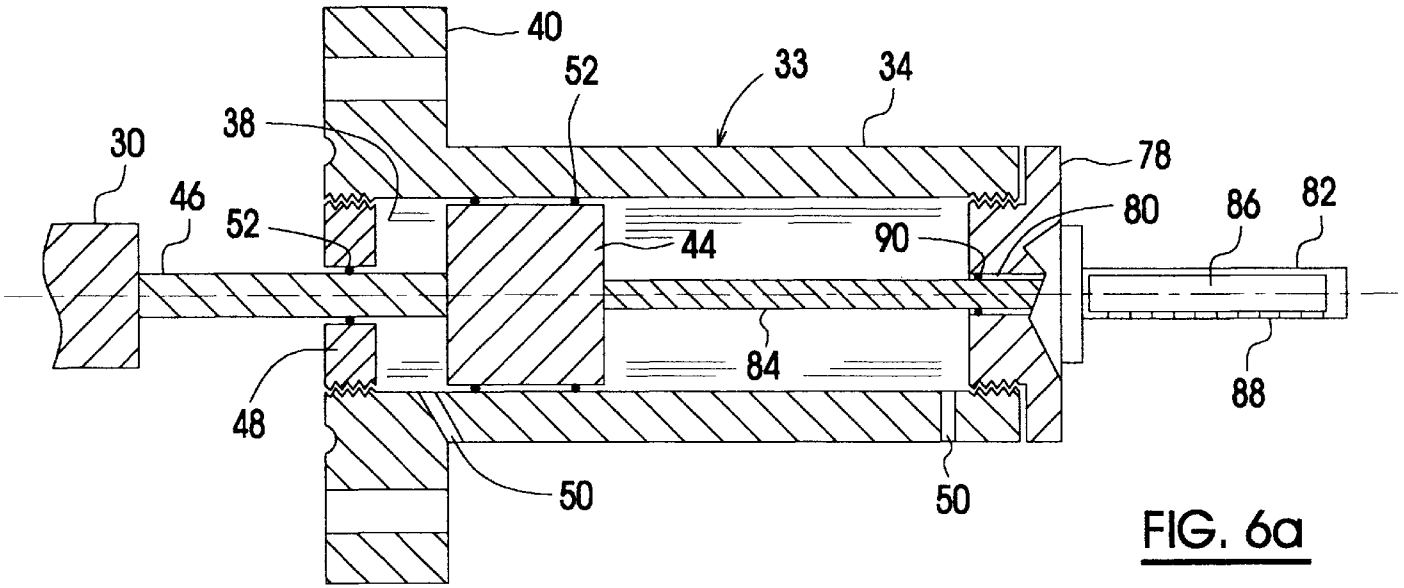
FIG. 6*a* is a cross-sectional view of a hydraulic cylinder, partially in a side view, showing a slip position indicator in accordance with a further embodiment of the invention.

FIG. 6*a* illustrates another embodiment of the hydraulic actuators 32 shown in FIGS. 1, 2 and 3. An hydraulic actuator 33 has an indicator shaft 84 for indicating a position of the slip blocks 30 with respect to the axial passage 14 of the slip spool 12, as shown in FIGS. 1 and 3. The hydraulic actuator 33 has components and structural features similar to those of hydraulic actuators 32, which are indicated by similar numerals in FIG. 1 and are not described. The hydraulic actuator 33 includes an outer end plate 73 threadedly mounted to the outer end of the cylinder 34. The end plate 78 has a central bore 80 through which the indicator shaft 84 reciprocates. A tubular sheath 82 extends outwardly from the end plate 78. The tubular sheath 82 is aligned with a central bore 80 of the end plate 78 so that the indicator shaft 84, which is connected at its inner end to the piston 44, is surrounded and protected by tubular sheath 82. A sight window 86 in the tubular sheath 82 permits an outer end of the indicator shaft 84 to be viewed as the indicator shaft 84 moves with the slip block 30. Indicator marks 88 may be provided on the tubular sheath 82 to indicate a position of the associated slip block 30 with respect to the axial passage 14. An O-ring 90 is provided between the indicator shaft 84 and the central bore 80 of the end plate 78 to prevent hydraulic fluid leakage.

Figure 6B:
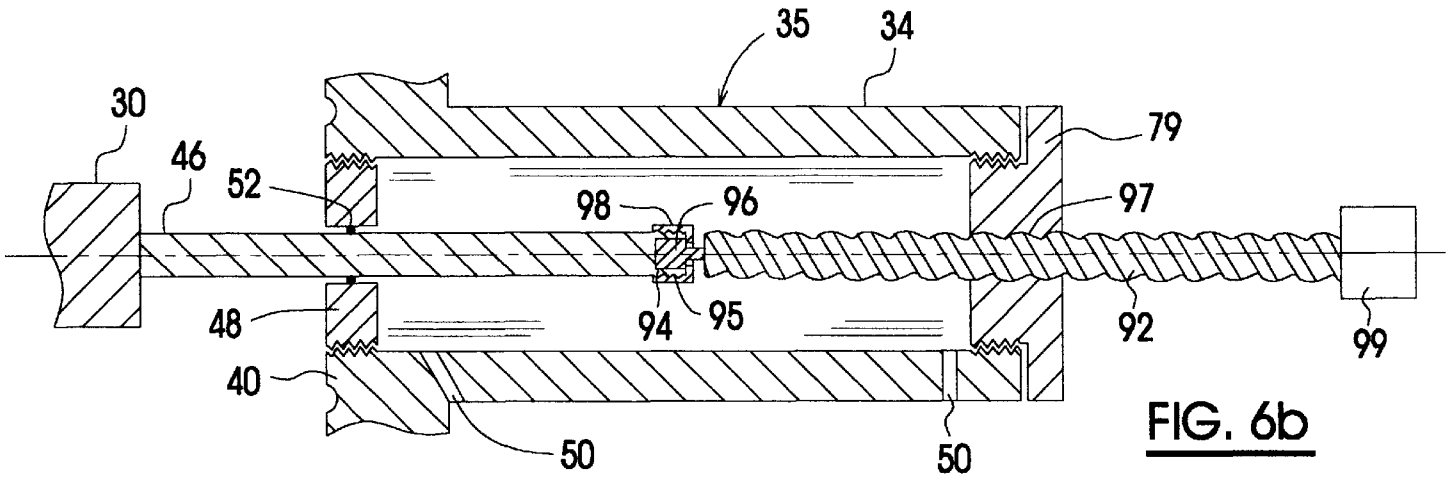
FIG. 6*b* is a cross-sectional view of an alternate embodiment of an actuator used to extend and retract slip blocks of a slip spool in accordance with the invention.

FIG. 6*b* illustrates an alternate embodiment of an actuator 35 that can be used to extend and retract the slip blocks 30 into and out of the axial passage 14 (FIGS. 1–3). The actuator 35 uses a mechanical screw 92 to apply the force required for extending and retracting the slip blocks 30. The mechanical screw 92 is threaded through mechanical screw threads 97 in the end plates 79 of the cylinder 34. The cylinder 34 is not filled with hydraulic fluid but may be packed with a lubricating grease, or the like. The mechanical screw 92 is connected to the piston rod 46 by a cylinder 96 retained in a socket 94 by retaining nut 98 that engages external threads 95 on an outer wall of the socket 94, in a manner well known in the art. The cylinder 96 is connected to, or machined on an inner end of the mechanical screw 92. The cylinder 96 retained in the socket 94 by the retainer net 98 permits the mechanical screw 92 to be rotated using, for example, an hexagonal nut 99 on an outer end of the mechanical screw. Rotation of the mechanical screw 92 translates into axial force on the piston rod 46 to extend or retract the slip block 30.

Figure 7:
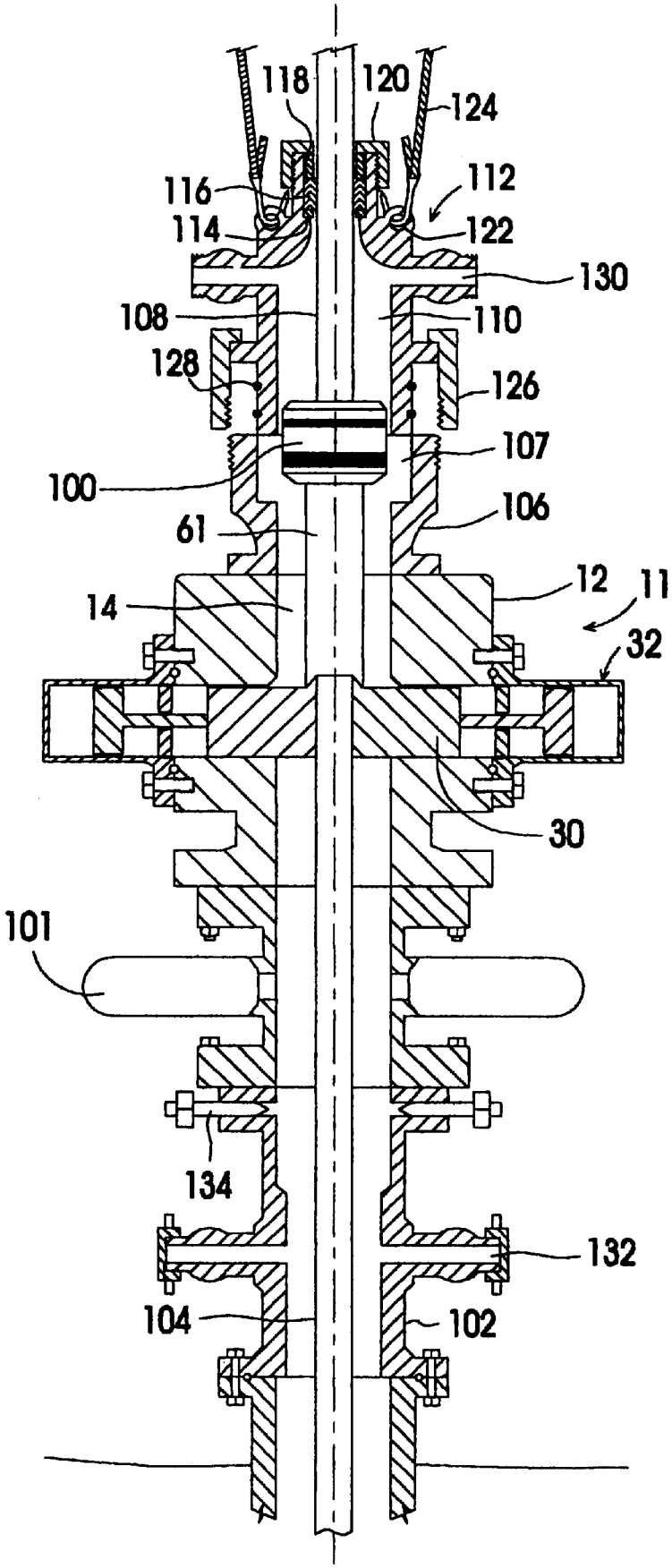
FIG. 7 is a cross-sectional view of a wellhead equipped with the apparatus illustrated in FIG. 3 in a process of installing a tubing hanger with attached tubing string in a tubing head spool in a live well without using a service rig.

FIG. 7 illustrates a procedure of using an apparatus 10, 11 described in detail with reference to FIGS. 2 and 3, to install a tubing hanger 100 into the tubing head spool 102, or to remove it from the tubing head spool 102. It is well known in the art that the tubing hanger 100 must be set in the tubing head spool 102 in order to suspend the production tubing string 104 in the well after the production tubing string 104 has been run into the well during well completion, as described in Applicant's co-pending U.S. patent application Ser. No. 09/791,980 entitled METHOD AND APPARATUS FOR INSERTING A TUBING HANGER INTO A LIVE WELL, which was filed on Feb. 23, 2001, the specification of which is incorporated herein by reference. It is also well known that the tubing hanger 100 must be removed from the tubing head spool 102 when a mandrel of a BOP protector is to be inserted into the wellhead (see FIGS. 9 and 9*a*), as explained, for example, in Applicant's co-pending U.S. patent application Ser. No. 09/537,629 entitled BLOWOUT PREVENTER PROTECTOR AND METHOD OF USING SAME, which was filed on Mar. 29, 2000 and is also incorporated herein by reference. It is furthermore well known that slips are required to be set and removed to support the tubing string 104 during many other well operations, particularly if the operation requires any manipulation of the tubing string 104.

The apparatus 11 permits slip blocks 30 to be extended or retracted under well pressure of a live well without killing the well. The apparatus 11 is mounted to a top of a BOP 101, which is mounted to a top of a tubing head spool 102. Mounted on the top of the slip spool 12 is a Bowen union 106, well known in the art.

A landing joint 108 is adapted to be connected to the tubing hanger 100. The landing joint 108 is inserted through a passage 110 of an annular adapter 112, as described in Applicant's co-pending U.S. patent application Ser. No. 09/791,980 referenced above. The passage 110 includes a packing cavity at a top thereof, which retains a steel packing washer 114. A high pressure packing 116, such as a chevron packing, is retained above the steel packing washer 114. The high pressure packing 116 closely surrounds and provides a high pressure seal around the landing joint 108 in order to ensure that well fluids do not escape to atmosphere when the tubing hanger 100 is inserted into, or removed from the tubing head spool 102. The high pressure packing 116 is retained by a gland nut 118. A safety nut 120 threadedly engages a spiral thread on an outer periphery of the top end of the annular adapter 112. A top wall of the safety nut 120 projects inwardly to cover the gland nut 118 in order to ensure that the gland nut 118 is not stripped by fluid pressures exerted on the high pressure packing 116.

A side wall of the annular adapter 112 includes at least two eyes or hooks 122 which receive chain or cable 124 that is connected to a hoisting mechanism, such as a boom truck (not shown), in order to suspend the annular adapter 112 while the landing joint 108 is connected to a top end of the tubing hanger 100.

The slip blocks 30 of the apparatus 11 are in the extended position, to support the beveled bottom end of the adapter pin 61 which was connected to the top of the tubing string 104 after the tubing string 104 was run into the well during the well completion operation. A retrievable plug (not shown) seals the tubing string 104 to prevent well fluids within the well from flowing out through the tubing string 104. A top end of the adapter pin 61 extends up through the slip spool 12 to at least near a top of the annular Bowen union 106. After the tubing hanger 100 is connected to the top of the adapter pin 61, the annular adapter 112 with the landing joint 108 extending therethrough, is hoisted above the wellhead.

The landing joint 108 is then connected to the top end of the tubing hanger 100, and the annular adapter 112, which is suspended from the cables 124 by the boom truck, is lowered and slides down around the landing joint 108 so that a lock nut 126 of the annular adapter 112 can be threadedly engaged with the threaded connector 106. O-rings 128 around the annular adapter 112 seal the interface between the annular adapter 112 and the Bowen union 106. Thus the axial passage 14 of the slip spool 12 is sealed against leakage when the bleed ports 130 of the annular adapter 112 are closed.

Pressure is then equalized between an annulus of the live well below the tubing rams of the BOP 101 and the axial passage 14 of the slip spool 12, which communicates with the annular adapter 112, using a bleed hose (not shown) between the pressure bleed ports 130 on the annular adapter 112 and corresponding ports or valves 132 of the tubing head spool 102. After the respective valves are closed, the tubing rams of the BOP 101 are opened in order to permit the tubing hanger 100 to be lowered into the tubing head spool 102.

The landing joint 108 is connected to a lifting mechanism such as a service rig (not shown) so that the landing joint 108 with the entire tubing string 104 suspended therefrom, is lifted by operating the service rig to remove the weight of the tubing string 104 from the slip blocks 30 of the apparatus 11. The slip blocks 30 are then moved to the retracted position as shown in FIG. 1 by operating the hydraulic actuators 32 to clear the axial passage 14 of the slip spool 12. The retracting of slip blocks 30 is performed under well pressure because the tubing rams of the BOP 101 are fully opened. This permits the tubing hanger 100 to lowered together with the tubing string 104 in one stroke through both the slip spool 12 and the BOP 101, until the tubing hanger 100 is in position within the tubing head spool 102. Once the tubing hanger 100 is seated in the tubing head spool 102, lock bolts 134 are adjusted to lock the tubing hanger 100 within the tubing head spool 102.

The landing joint 108 is then rotated to disconnect it from the tubing hanger 100, and the landing joint 108 is pulled up by the service rig or the boom truck until the landing joint 108 is above the blind rams of the BOP 101. After the blind rams of the BOP 101 are closed, pressure is vented from the annular adapter 112 by, for example, opening the pressure bleed ports 130. Subsequently, the annular adapter 112 and the Bowen union 106, if desired, can be removed by the boom truck.

The steps required to remove the tubing hanger 100 from the tubing head spool 102 are a reverse of the above-described process.

Figure 7A:
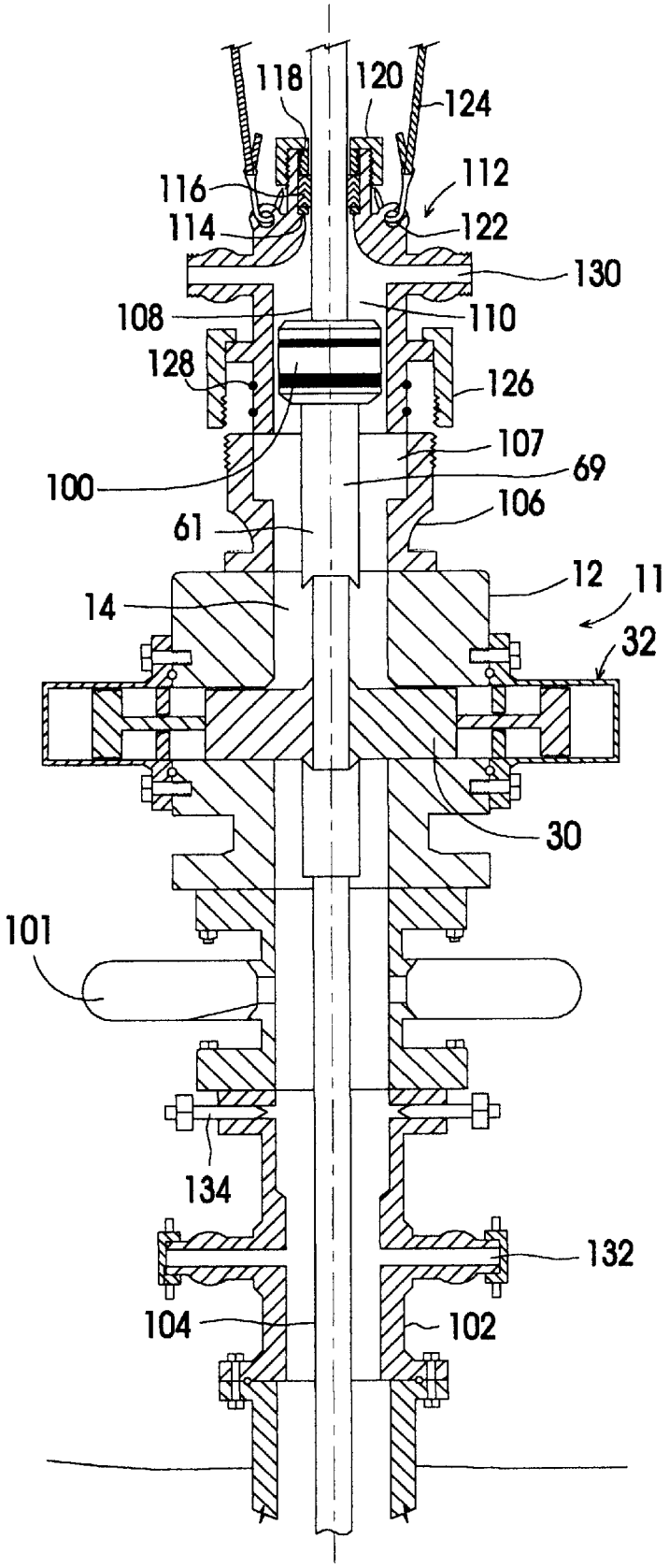
FIG. 7*a* is a cross-sectional view of a wellhead equipped with an apparatus shown in FIG. 3*b* in a process of installing a tubing hanger with attached tubing string in a tubing head spool in a live well in which the natural well pressure overbears a weight of the tubing string, and snubbing is required.

FIG. 7*a* illustrates the process described above when the tubing hanger 100 must be inserted into a live well with a high natural pressure that overbears a weight of the tubing string 104. The tubing adapter 69 is used instead of the tubing adapter 61 shown in FIG. 7. As can be seen, the pressure in the well forces the bottom shoulder 73 against the wedge-shaped ridge 75 of the slip blocks 30, which snub upward movement of the tubing string 104. In all other respects, the process is the same as described above.

Figure 8:
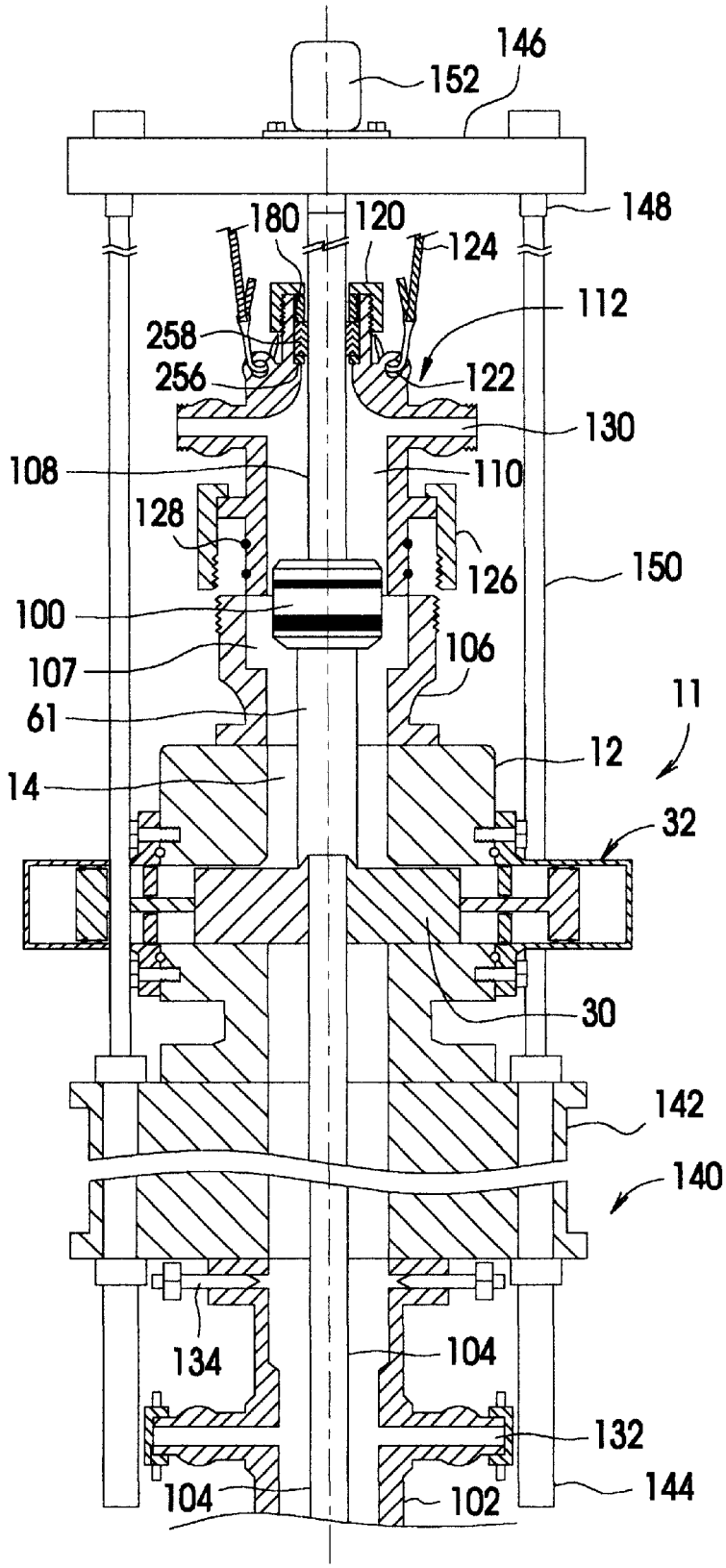
FIG. 8 is a cross-sectional view of a wellhead equipped with the apparatus illustrated in FIG. 3, in a rigless service for installing a tubing hanger with the tubing string in a tubing head spool in a live well.

FIG. 8 illustrates another example of using apparatus 11 in a rigless well servicing operation to install the tubing hanger 100 into the tubing head spool 102 or remove it from the tubing head spool 102. In this example apparatus 140 replaces the conventional BOP 101 of FIG. 7. Apparatus 140 includes a BOP 142 having tubing rams and blind rams similar to those of a conventional BOP. A pair of bi-directional prime movers, such as hydraulic cylinders 144 are secured to the BOP 142 at opposed sides thereof. Apparatus 140 is described in Applicant's co-pending U.S. patent application entitled SPOOL FOR PRESSURE CONTAINMENT USED IN RIGLESS WELL COMPLETION, RE-COMPLETION, SERVICING OR WORKOVER, filed on Nov. 15, 2001, the specification of which is incorporated herein by reference.

The procedure to be described below with reference to FIG. 8 is similar to the procedure illustrated in FIG. 7, and the same steps are not described. The major difference between the procedure illustrated in FIG. 7 and the procedure illustrated in FIG. 8 lies in that the lifting of and lowering of the tubing hanger 100 with the tubing string 104 suspended therefrom are accomplished by operating the hydraulic cylinders 144 of the apparatus 140 rather than by using a conventional rig. In order to connect the landing joint 108 to the cylinders 144, the landing joint 108 is rotatably suspended from and supported by a base plate 146 before it is inserted into the annular adapter 112, and hoisted together with the annular adapter 112 above the threaded connector 106 which is mounted on the top of the slip spool 12. Two extension rods 150 are also connected at their top ends to the base plate 146. The combination of the annular adapter 112, the landing joint 108 and the rotatably connected base plate 146 with the extension rods 150, is then lowered to permit the lower end of the landing joint 108 to be connected to the top end of the tubing hanger 100, which has already been mounted to a top of the pin adapter 61 at the top of the Bowen union 106. After the landing joint 108 is connected to the top end of the tubing hanger 100, the two extension rods 148 of an adequate length, are connected to the piston rams 150 of the respective hydraulic cylinders 144, which are hydraulically locked in a position close to their fully extended condition. The annular adapter 112 is then further lowered by operating the boom truck suspending the chains or cables 124, and slides down over the landing joint 108 until the lock nut 126 of the annular adapter 112 engages the threads of the threaded connector 106 and the O-rings 128 around the annular adapter 112 seal the interface between the annular adapter 112 and the Bowen union 106.

The tubing rams of the BOP are opened to clear the passage for the tubing hanger 100 to be inserted therethrough into the tubing head spool 102 after well pressure between the annulus above the BOP 142 and in the annulus below the BOP 142 is balanced. The hydraulic cylinders 144 are actuated to lift the base plate 146 and the tubing string 104 suspended therefrom in order to remove the weight of the tubing string 104 from the slip blocks 30 of the apparatus 11, which support the beveled bottom end of the adapter pin 61. Thus, the slip blocks 30 can be retracted from the extended position under well pressure to clear the axial passage 14 of the slip spool 12. The hydraulic cylinders 144 are then operated to lower the tubing string 104 and insert the tubing hanger 100 into the tubing head spool 102.

A further example of using the apparatus 11 in a live well operation is described below with reference to FIGS. 9 and 9*a*. A mandrel 160 of a BOP protector having a pack-off assembly 162 at a bottom end thereof, is to be inserted through a well head 98 from which a tubing string 104 is suspended. The tubing string 104 is supported by the slip blocks 30 of the apparatus 11, which is mounted to a top of the apparatus 140 of the wellhead 98. The apparatus 140 is the same as that described with reference to FIG. 8, and is mounted to a tubing head spool 102. The tubing string 104 is normally supported by a tubing hanger inside the tubing head spool 102 but the tubing hanger has been pulled out of the well in a procedure which is a reverse of the tubing hanger insertion process described with reference to FIG. 8. Thus, the top end of the adapter pin 61, which is connected to the top end of the tubing string 104, and is supported at the beveled bottom end on the slip blocks 30 of the apparatus 11, extends through the central bore of the Bowen union 106. A pup joint 164 which has a length greater than the length of the mandrel 160 having a box thread (not shown) at the bottom thereof is connected to the pin threads 66 (FIG. 3) at the top of the adapter pin 61. The mandrel 160 is equipped with an annular adapter 166. The annular adapter 166 includes packing rings 168 constructed of brass, rubber and fabric disposed within the annular adapter 166 and secured by a gland nut 170. The packing rings 168 and the gland nut 170 define a vertical passage of a same diameter as a periphery of the mandrel, to provide a fluid seal between the mandrel 160 and the annular adapter 166.

The mandrel 160, which is surrounded by the annular adapter 166, is connected at its top end to a connector 172 that includes a base plate 174. The connection of the top end of the mandrel 160 to the connector is described in detail in Applicant's patent applications referenced above. The connector 172 further includes a lock nut 176 for engagement with the external threads of the annular adapter 166. A fracturing head 178 having a central passage 180, and at least two radial passages 182, is mounted to the top of the base plate 174. Two high pressure valves 184 are also mounted to the fracturing head 178 to close the radial passages 182, respectively. The combination of the fracturing head 178 and the base plate 174 with all other components attached thereto is hoisted above the wellhead 98. The mandrel 160 is then aligned with the pup joint 164 and is lowered over the pup joint 164 until the pack-off assembly 162 at the bottom end of the mandrel 160 is inserted into the axial passage 14 of the slip spool 12 above the slip blocks 30 and the annular adapter 166 is received in the landing bowl 107 of the Bowen union 106. The lock nut 169 of the annular adapter 166 is then connected to the Bowen union 106 to securely lock the connection of the annular adapter 166 with the threaded connector 106. The pup joint 164 is long enough that the top end 186 of the pup joint 164, which has a pin thread, extends above the top end of the fracturing head 178.

A tubing adapter 188 is then connected to the top end 186 of the pup joint 164. The tubing adapter 188 is also connected to the top of the fracturing head 178. The extension rods 148 of an adequate length are then connected at their lower end to the piston ram 150 of the respective hydraulic actuators 144 and at their upper end to the base plate 174 by means of the hex head 190 and a connector 192. After the base plate 174 is connected to the hydraulic cylinders 144, a high pressure valve 194 (partially shown) can be hoisted by the boom truck (not shown) to the top of the tubing adapter 188. The high pressure valve 194 is then mounted to the top of the tubing adapter 188.

The weight of the tubing string 104 and the combination of the connector 172 with the base plate 174, the fracturing head 178, and all other components attached thereto is supported on the slip blocks 30 of the apparatus 11 by the adapter pin 61. In order to retract the slip blocks 30 to clear the axial passage 14 of the slip spool 12, the weight of the tubing string 104 and all attachments must be removed by operating the hydraulic actuators 144 to extend piston rams 150 to slightly lift the base plate 174. This can be done either before or after the well pressure is equalized across the BOP and the tubing rams (not shown) of the BOP 142 are opened.

After the tubing rams of the BOP 142 of the apparatus 140 are opened and the slip blocks 30 are moved to the retracted position (see in FIG. 1), the cylinders 144 are operated to lower the mandrel 160 down through the slip spool 12 and the BOP 142. When the mandrel 160 is in an operating position, the bottom end of the pack-off assembly 162 is in sealing contact with a bit guide 196 connected to a top of the well casing 198. The bit guide 196 caps the well casing 198 to protect the top end of the well casing 198 and provides a seal between the well casing 198 and the tubing head spool 102, in a manner well known in the art.

The mandrel 160 has optional and variable lengths of extension sections. Thus, the assembled mandrel 160 including the pack-off assembly 162, is pre-adjusted in length to ensure that the lock nut 176 can be threadedly engaged with the annular adapter 166 when the pack-off assembly 162 is seated against the bit guide 196.

Figure 9B:
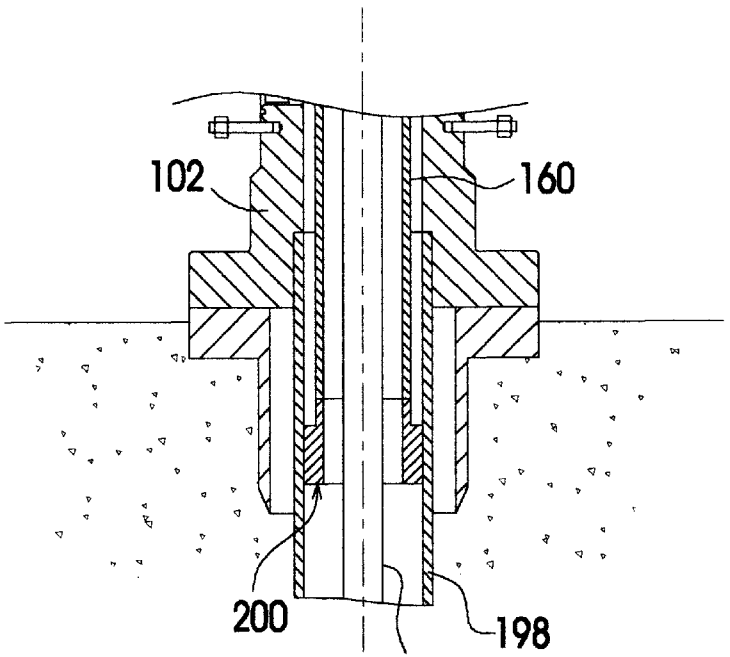
FIG. 9*b* is a partial cross-sectional view of a lower portion of a wellhead in which a mandrel of a blowout preventer protector having a sealing assembly is inserted by the equipment illustrated in FIGS. 9 and 9*a,* in order to seal off against the well casing.
Figure 9:
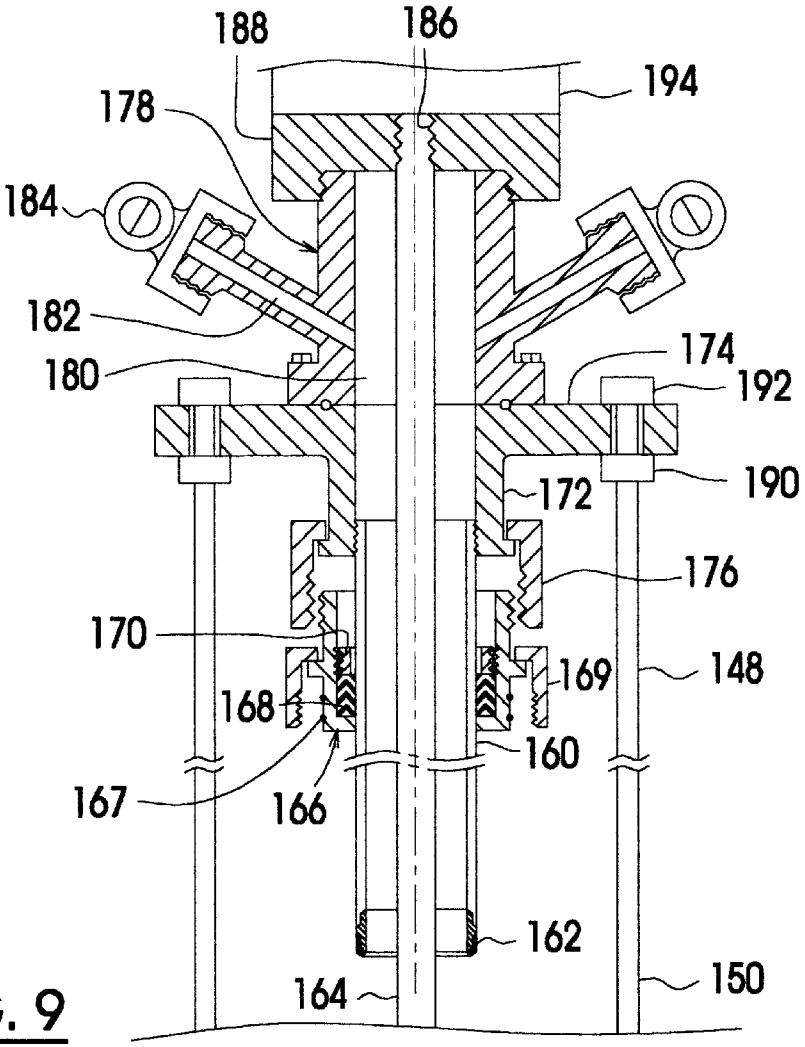
FIGS. 9 and 9*a* are cross-sectional views of a wellhead equipped with the apparatus illustrated in FIG. 3, in a process of inserting a mandrel of a blowout preventer protector connected to a tubing string in the wellbore without using a service rig.
Figure 9A:
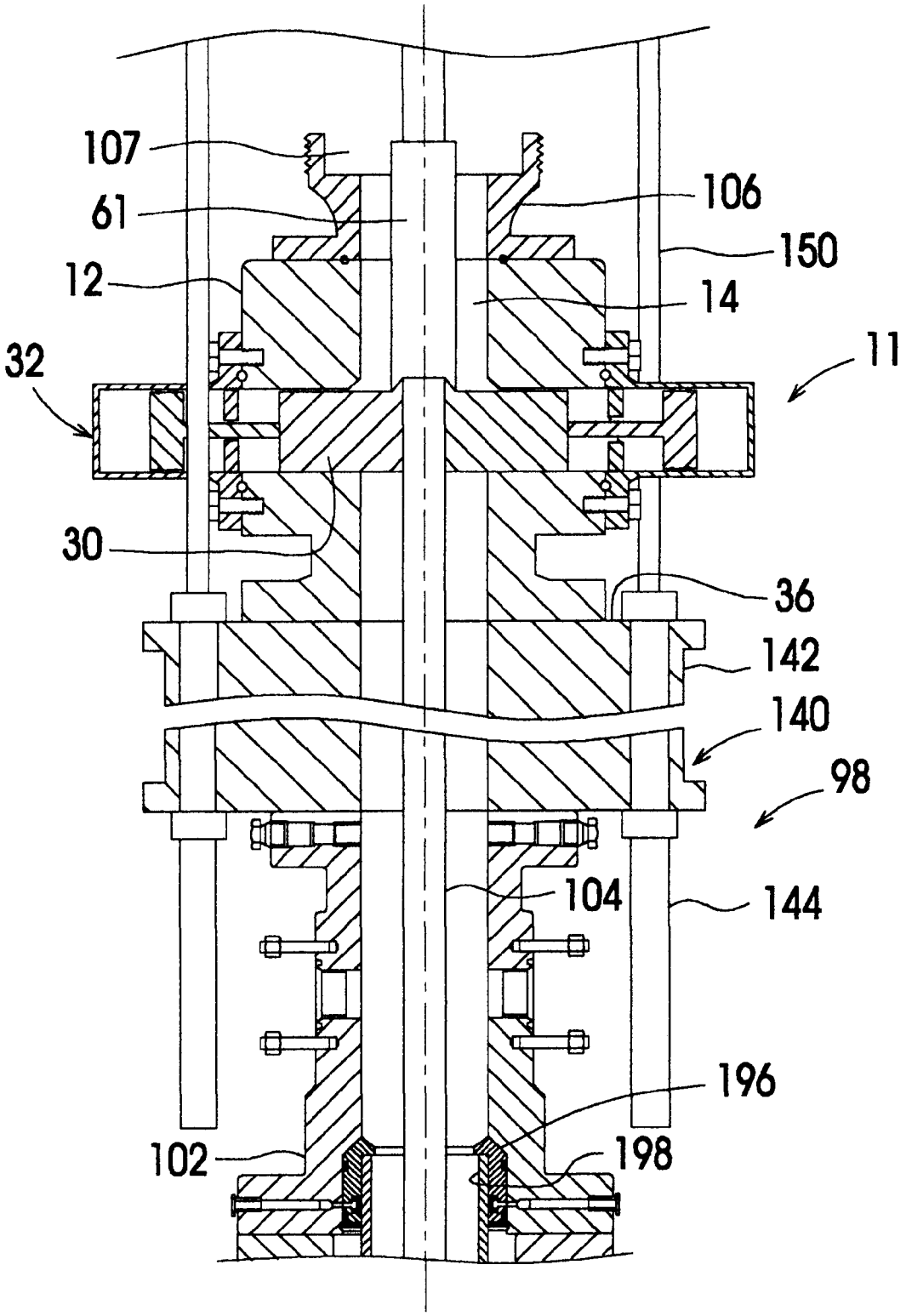

A conventional BOP that does not have hydraulic cylinders, for example, the BOP 101 illustrated in FIG. 7, may be used in place of the apparatus 140 shown in FIG. 9*a*. If so, the connector 172 having the base plate 174 is connected to a service rig or some other injection tool capable of supporting the weight that is not offset by the well pressure of the tubing string.

FIG. 9*b* illustrates a further example of using the apparatus 11. In this example, the mandrel 160 is to be inserted into a live well with the tubing string 104 suspended by the slip blocks 30 of the apparatus 11 mounted on the wellhead as shown in FIG. 9*a*. In this application the tubing head spool 102 is directly connected to the well casing 198 without the bit guide 196 (see FIG. 9*a*). Therefore, the bottom end of the mandrel 160 must be extended into the well casing 198 to seal against the well casing 198. A sealing assembly 200 attached to a bottom end of the mandrel 160 includes a cup having a resilient depending skirt and other components to retain the cup, as described in Applicant's co-pending U.S. patent application Ser No. 09/537,629, filed Mar. 19, 2000, the specification of which is incorporated herein by reference. When the sealing assembly 200 is inserted into the well casing 198, the cup of the sealing assembly 200 radially expands under well pressure against the inner surface of the well casing 198, thereby sealing against the well casing 198. Otherwise, the equipment and tools are the same as used in the operation described with reference to FIGS. 9 and 9*a* and similar steps are followed.

Although the invention has been principally described with reference to operations in which slips are required to support the weight of a tubular string in a well bore, which is the most commonly encountered condition in well servicing, it should be understood that the apparatus in accordance with the invention is equally adapted to be used as a snubbing unit as described above in any downhole well servicing operation. The apparatus can be used in various other applications required for selectively supporting or snubbing a tubing string suspended in a wellbore. The embodiments of the invention described above should be understood to be exemplary only. Modifications and improvements to those embodiments of the invention may become apparent to those skilled in the art. The foregoing description is intended to be exemplary rather than limiting. The scope of the invention is therefore intended to be limited solely by the scope of the appended claims.

I claim:

1. A slip spool for selectively supporting or snubbing a tubing string suspended in a wellbore comprising:

a pressure containment spool adapted to be mounted to a wellhead, the spool having an axial passage to be aligned with the wellbore for permitting the tubing string to extend therethrough, and at least two radial passages extending through a side wall of the spool and communicating with the axial passage;

at least two slip blocks slidably supported within the respective radial passages, each of the at least two slip blocks comprising a wedge-shaped ridge along an upper surface of a contoured inner end thereof so that the ridges engage a beveled recess formed in the weight-bearing shoulder of an adapter pin in the tubing string when the slip blocks are in the extended position; and means for moving the respective slip blocks between an extended position in which the slip blocks engage a component in the tubing string having a weight-bearing shoulder adapted to be engaged by the slip blocks, and a retracted position in which the slip blocks clear the axial passage of the spool.

2. A slip spool as claimed in claim 1, wherein the at least two radial passages are substantially perpendicular to the axial passage.

3. A slip spool as claimed in claim 1, wherein each of the at least two slip blocks comprises a wedge-shaped ridge along a lower surface of a contoured inner end thereof so that the ridges engage a beveled recess formed in a weight-bearing shoulder of an adapter pin in the tubing string when the slip blocks are in the extended position.

4. A slip spool as claimed in claim 1, wherein the at least two slip blocks further comprise fluid seals so that in the extended position the slip blocks close an annulus between the tubing string and the side wall of the axial passage of the spool in a fluid-tight seal.

5. A slip spool as claimed in claim 1, wherein the means for moving the at least two slip blocks comprises at least two hydraulic actuators mounted to the spool and connected to the respective slip blocks.

6. A slip spool as claimed in claim 5, wherein each of the hydraulic actuators comprises an indicator for indicating a position of the respective slip block moved by the hydraulic actuator.

7. A slip spool as claimed in claim 1, wherein the means for moving the at least two slip blocks comprises at least two mechanical screw actuators mounted to the spool and connected to the respective slip blocks.

8. An apparatus for selectively supporting a tubing string suspended in a wellbore comprising:

a pressure containment spool adapted to be mounted to a wellhead, the spool having an axial passage to be aligned with the wellbore for permitting the tubing string to extend therethrough, and at least two radial passages extending through a side wall of the spool and communicating with the axial passage;

an adapter pin adapted to be connected to the tubing string, the adapter pin providing a weight-bearing shoulder for supporting the tubing string;

at least two slip blocks slidably supported within the respective radial passages, each of the at least two slip blocks comprising a wedge-shaped ridge along a contoured upper surface of an inner end thereof so that the ridges engage a beveled recess formed in the weight-bearing shoulder of the adapter pin when the slip blocks are in the extended position; and means for moving the respective slip blocks between an extended position in which the slip blocks engage the weight-bearing shoulder of the adapter pin, and a retracted position in which the slip blocks clear the axial passage of the spool.

9. An apparatus as claimed in claim 8, wherein the at least two radial passages are substantially perpendicular to the axial passage.

10. A slip spool as claimed in claim 8, wherein each of the at least two slip blocks comprises a wedge-shaped ridge along a lower surface of a contoured inner end thereof so that the ridges engage a beveled recess formed in a weight-bearing shoulder of an adapter pin in the tubing string when the slip blocks are in the extended position.

11. An apparatus as claimed in claim 8, wherein the at least two slip blocks further comprise fluid seals so that in the extended position the slip blocks close an annulus between the tubing string and the side wall of the axial passage of the spool in a fluid-tight seal.

12. An apparatus as claimed in claim 8, wherein the means for moving the at least two slip blocks comprises at least two hydraulic actuators mounted to the spool and connected to the respective slip blocks.

13. An apparatus as claimed in claim 12, wherein each of the hydraulic actuators comprises an indicator for indicating a position of the respective slip block moved by the hydraulic actuator.

14. An apparatus as claimed in claim 8, wherein the means for moving the at least two slip blocks comprises at least two mechanical screw actuators mounted to the spool and connected to the respective slip blocks.

15. An adapter pin for providing a weight-bearing shoulder in a tubing string to be supported by slip blocks of a slip spool, comprising a tubular collar having threads at top and at bottom ends thereof for connecting the adapter pin to the tubing string, and the bottom end further including an inward and upward beveled recess for receiving a wedge-shaped ridge along a contoured upper surface of an inner end of the respective slip blocks, so that the ridges engage the beveled recesses when the slip blocks are in an extended position in which the slip blocks contact the tubing string beneath the adapter pin.

16. An adapter pin as claimed in claim 15, wherein the tubular collar comprises a box thread at the bottom end and a pin thread at the top end.

17. An adapter pin as claimed in claim 15, wherein the tubular collar comprises a box thread at the bottom end and a box thread at the top end.

18. An adapter pin as claimed in claim 15, wherein the tubular collar has a length such that the top end extends above a top of the slip spool when the bottom end of the tubular collar is supported by the slip blocks extended inwardly from a side wall of the slip spool to support the tubing string.

19. An adapter pin for providing weight-bearing shoulders in a tubing string to be supported or snubbed by slip blocks of a slip spool, comprising a tubular collar having threads at top and bottom ends thereof for connecting the adapter pin to the tubing string, and an area of reduced diameter between the top and bottom ends with a first weight-bearing shoulder at a top and a second weight-bearing shoulder at a bottom of the area of reduced diameter, the first weight-bearing shoulder being adapted to cooperate with the slip blocks to support the tubing string, while the second weight-bearing shoulder is adapted to cooperate with the slip blocks to snub the tubing string if the tubing string requires snubbing.

20. An adapter pin as claimed in claim 19, wherein the tubular collar comprises a box thread at the bottom end and a pin thread at the top end.

21. An adapter pin as claimed in claim 19, wherein the tubular collar comprises a box thread at the bottom end and a box thread at the top end.

22. An adapter pin as claimed in claim 19, wherein the tubular collar has a length such that the top end extends above a top of the slip spool when the first weight-bearing shoulder rests against the slip blocks.

23. A method for setting and using an apparatus for selectively supporting or snubbing a tubing string suspended in a wellbore during a well operation, comprising steps of:

mounting a slip spool to a ton of a wellhead of a live well, the slip spool including:

an axial passage to be aligned with a wellbore for permitting a tubing string to extend therethrough, and at least two radial passages extending through a side wall of the slip spool and communicating with the axial passage;

at least two slip blocks slidably supported in the respective at least two axial passages; and means for moving the respective slip blocks between an extended position in which the slip blocks engage a component in the tubing string having a weight-bearing shoulder adapted to be engaged by the slip blocks, and a retracted position in which the slip blocks clear the axial passage of the spool;

connecting to a ton of the slip spool means for containing well pressure in the axial passage while permitting any one of a tubular, a downhole tool and a wellhead component to be inserted through the axial passage into the live well;

balancing pressure between the live well and the axial passage of the slip spool;

operating a flow control mechanism in the wellhead, as required, to open the wellbore in order to permit the any one of a tubular, a downhole tool and a wellhead component to be inserted into the live well under well pressure; and moving the slip blocks selectively between the extended and retracted positions, as required, during the live well operation.

24. A method as claimed in claim 23, further comprising a step of removing weight from the slip blocks when the slip blocks are to be retracted from the extended position.

25. A method as claimed in claim 23, wherein connecting and operating steps further comprise:

connecting a Bowen union to the top of the slip spool;

hoisting a landing joint and an annular adapter into position over the slip spool;

connecting the landing joint to a tubing hanger which is connected to the tubing string by means of an adapter pin, a bottom end of the adapter pin providing the weight-bearing shoulder supported by the slip blocks of the slip spool;

lowering the annular adapter relative to the landing joint and connecting the annular adapter to the Bowen union;

lifting the landing joint to remove the weight of the tubing string from the slip blocks before moving the slip blocks from the extended position to the retracted position; and lowering the tubing string to insert the tubing hanger through the wellhead into position in a tubing head spool of the live well.

26. A method as claimed in claim 23, wherein the connecting and operating steps further comprise:

connecting a Bowen union to the top of the slip spool;

hoisting a fracturing head that supports a mandrel and an annular adapter into position over the slip spool;

lowering the mandrel and the fracturing head over a pup joint which is connected to the tubing string by means of an adapter pin, a weight-bearing shoulder of the adapter pin being supported by the slip blocks of the slip spool, so that a top of the pup joint extends above a top of the fracturing head;

connecting the annular adapter to the Bowen union;

connecting a tubing adapter to the top of the pup joint, and connecting the tubing adapter to the fracturing head;

moving the fracturing head to remove weight from the tubing string on the slip blocks before moving the slip blocks from the extended position to the retracted position; and lowering the tubing string to insert the mandrel through the wellhead into sealing engagement with a casing of the live well.

27. A method as claimed in claim 23, further comprising a step of inserting the any one of a tubular, a downhole tool and a wellhead component through the wellhead into position in the live well by means of prime movers incorporated into a spool for pressure containment having a flow control mechanism for selective containment of pressurized fluid with the wellbore, the spool for pressure containment being mounted in the wellhead under the slip spool.

28. A method as claimed in claim 27, further comprising a step of using the prime movers to move the tubing string in order to remove weight from the slip blocks when the slip blocks are to be retracted from the extended position.

* * * * *

UNITED STATES PATENT AND TRADEMARK OFFICE

CERTIFICATE OF CORRECTION

PATENT NO. : 6,695,064 B2
DATED : February 24, 2004
INVENTOR(S) : L. Murray Dallas It is certified that error appears in the above-identified patent and that said Letters Patent is hereby corrected as shown below:

Title page,
Item [56], References Cited, OTHER PUBLICATIONS, "U.S. patent applications Ser. No. 09/791,980, filed Nov. 15, 2001" should read -- U.S. patent application Ser. No. 09/998,953, filed Nov. 15, 2001. --.

Column 8,
Line 53, before "Bowen", please delete the word "annular".

Column 14,
Line 63, before "of a wellhead", please delete the word "ton" and replace with -- top --.

Column 15,
Line 11, before "of the slip", please delete the word "ton" and replace with -- top --.

Signed and Sealed this

Twentieth Day of September, 2005

JON W. DUDAS
*Director of the United States Patent and Trademark Office*